US005216987A

United States Patent [19]

Clarke

[11] Patent Number: 5,216,987

[45] Date of Patent: Jun. 8, 1993

[54] METHOD AND APPARATUS FOR OPTIMIZING BREATHING UTILIZING UNIT VALVE ACTUATION

[75] Inventor: John M. Clarke, Chillicothe, Ill.

[73] Assignee: Caterpillar Inc., Peoria, Ill.

[21] Appl. No.: 891,612

[22] Filed: Jun. 1, 1992

[51] Int. Cl.[5] ..... F01L 9/04; F02B 75/18

[52] U.S. Cl. ..... 123/90.11; 123/90.15; 123/316

[58] Field of Search ..... 123/90.11, 90.15, 90.16, 123/90.17, 316

[56] References Cited

U.S. PATENT DOCUMENTS

| | | | |
|---|---|---|---|
| 3,935,846 | 2/1976 | Zelenka | 123/117 R |
| 4,176,624 | 12/1979 | Bielecki et al. | 123/32 EA |
| 4,691,672 | 9/1987 | Jones | 123/90.11 |
| 4,700,684 | 10/1987 | Pischinger | 123/90.11 |
| 4,779,582 | 10/1988 | Lequesne | 123/90.11 |
| 4,794,891 | 1/1989 | Knobloch | 123/90.11 |
| 4,829,947 | 5/1989 | Lequesne | 123/90.11 |
| 4,841,923 | 6/1989 | Buchl | 123/90.11 |
| 4,878,464 | 11/1989 | Richeson, Jr. et al. | 123/90.11 |
| 4,917,058 | 4/1990 | Nelson et al. | 123/316 |
| 4,942,851 | 7/1990 | Kawamura | 123/90.11 |
| 4,945,870 | 8/1990 | Richeson | 123/90.11 |
| 4,957,074 | 9/1990 | Weissler, II et al. | 123/90.11 |
| 4,961,406 | 10/1990 | Burandt | 123/90.15 |
| 4,995,351 | 2/1991 | Ohkubo et al. | 123/90.11 |
| 5,003,938 | 4/1991 | Erickson et al. | 123/90.14 |
| 5,009,203 | 4/1991 | Seki | 123/90.16 |
| 5,022,357 | 6/1991 | Kawamura | 123/90.11 |
| 5,042,436 | 8/1991 | Yamamoto et al. | 123/90.15 |
| 5,046,461 | 9/1991 | Kanehiro et al. | 123/90.15 |
| 5,050,543 | 9/1991 | Kawamura | 123/90.11 |

*Primary Examiner*—E. Rollins Cross
*Assistant Examiner*—Weilun Lo
*Attorney, Agent, or Firm*—Larry G. Cain

[57] ABSTRACT

Systems to optimize breathing have been used with internal combustion engines in the past and used a variety of mechanical mechanisms to improve breathing and combustion. Many of these systems fail to provide the option of controllably and modulatively varying the sequence and amount of the opening and closing of an intake or exhaust valve relative to a piston position in a cylinder bore. The present invention provides an electronic control system outputting an discrete control signal, and an opening device for unit actuation of each of the pair of valves independently. The electronic control system is programmable to respond in a first predetermined logic pattern for conventional operation of the engine at which time the intake valve is intermittently moved between the closed position and the open position during the intake stroke. The electronic control system is programmable to a second predetermined logic pattern to cyclicablly vary the opening of the intake valve during the intake stroke to effect an increase in the flow into the respective bore. The preestablished logic pattern controllably, sequentially and modulateably actuate the device for unit actuation, moving each of the valves independently between the open and closed position to effectively increase the trapped air within the bore when the valve is closed.

13 Claims, 4 Drawing Sheets

METHOD AND APPARATUS FOR OPTIMIZING BREATHING UTILIZING UNIT VALVE ACTUATION

TECHNICAL FIELD

The present invention relates generally to the controlled operation of engine operating modes. More particularly, the invention relates to a preestablished logic pattern, each cycle being adaptable to varying the preestablished logic pattern and the preestablished logic pattern controllably, sequentially and modulateably controlling valve timing to provide an improved optimized breathing system.

BACKGROUND ART

With mechanical components optimized breathing during the full cycle of engine operation, such as high and low speed or high and low loads, is difficult to obtain. Current methods compromise the efficiency and performance of the engine during the full range of cycles to provide efficiency and performance at a given cycle or narrow range.

An example of a mechanical method used to induce resonance in an intake system is disclosed in U.S. Reexamination Certificate B1 3,796,048 issued to Imre Annus et al. on May 31, 1983. The Reexamination discloses a supercharged internal combustion engine, an exhaust-turbo supercharger driven by exhaust gases from the cylinders which are divided into groups so that the suction strokes of the cylinders within a given group do not overlap, and a resonance induction pipe system connecting the inlet means in each cylinder to the delivery side of the supercharger so as to create conditions of dynamic charging in the induction pipe system to supplement the action of the supercharger.

An example of a device used to operate an inlet valve to increase fuel efficiency and reduce pollution is disclosed in U.S. Pat. No. 4,841,923 issued to Josef Buchi on Jun. 27, 1989. In this example, the valve is operated electromagnetically. Functionally, the valve opening and duration is accomplished through selective deenergization and energization of valve electromagnets.

Another example of a device used to operate a valve to increase intake and exhaust efficiencies is disclosed in U.S. Pat. No. 5,050,543 issued to Hideo Kawamura on Sep. 24, 1991. In this patent, a control system for controlling intake and exhaust valves includes an electromagnetic actuator means for electromagnetically operating the intake and exhaust valve. The electromagnetic actuator means is controlled depending on the rotational speed of the engine such that the range of crank angle for which the intake and exhaust valves are open will be smaller when the engine rotational speed is lower and larger when the engine rotational speed is higher.

The devices described above are used to increase efficiency of the engine operation. Some require additional or non-conventional hardware such as ceramic valves, magnetic components and specially designed manifolds and tubes. The result being increased customer cost and the greater possibility of hardware failure due to the increased number of components. Experimentation has also shown that magnetic actuated valve components lack speed and force when size constraints are taken into consideration.

The present invention is directed to overcome one or more of the problems as set forth above.

DISCLOSURE OF THE INVENTION

In one aspect of the invention, a breathing optimizing system is adapted for use with an engine. The engine includes a passage communicating with a pair of bores and a piston which during operation of the engine is movably positioned within respective bores between a top dead center position and a bottom dead center position. The movement forms an intake stroke. The system further includes a pair of valves operatively associated between the passage and the respective bore. The valves have a closed position and an open position. A means for opening each of the valves independently in response to receiving a control signal is included and an electronic control system is connected to the opening means. An output from the electronic control system sends the control signals to the opening means in a first predetermined logic pattern during normal engine operation, at which time, one of the valves is in the generally open position during the intake stroke. A breathing control means is connected to the electronic control system and causes discrete control signals to be outputted to the opening means in a second predetermined logic pattern. In the second predetermined logic pattern, the operation of the valves are varied so that one of the valves associated with the respective bores to cyclically vary the opening of the intake valve during the intake stroke to causes a preestablished resonance within the passage to effect an increase in the flow into the respective bore during the movement of the piston within the respective bore from the top dead center position to the bottom dead center position.

In another aspect of the invention, an engine has a passage communicating with a pair of bores and a piston which during operation of the engine is movably positioned within respective bores between a top dead center position and a bottom dead center position. The movement forms an intake stroke. The engine further includes a pair of valves operatively associated between the passage and the respective bore. The valves have a closed position and an open position. A means for opening each of the valves independently in response to receiving a control signal is included and an electronic control system is connected to the opening means. An output from the control system sends the control signals to the opening means in a first predetermined logic pattern during normal engine operation, at which time, one of the valves is in the generally open position during the intake stroke. The improvement is comprised of a breathing control means connected to the electronic control system which causes discrete control signals to be outputted to the opening means in a second predetermined logic pattern. The second predetermined logic pattern varies the operation of the valves so that one of the valves associated with the respective bore cyclically varies the opening of the intake valve during the intake stroke to causes a preestablished resonance within the passage to effect an increase in the flow into the respective bore during the movement of the piston within the respective bore from the top dead center position to the bottom dead center position.

In another aspect of the invention, a method for optimizing the breathing of an engine is disclosed. The engine has a passage communicating with a pair of bores and a piston which during operation of the engine is movably positioned within respective bores between a top dead center position and a bottom dead center position forming an intake stroke. The engine further includes a pair of valves operatively associated with the passage and controls communication between the passage and the respective bore. The valves have a closed position and an open position. The steps comprised in the method include: monitoring the operating condition of the engine, outputting a control signal to an opening means during a first predetermined logic pattern in which the engine is in a generally normal operating mode, outputting a discrete control signal to the opening means during a second predetermined logic pattern, varying the operation of the valves associated with the respective bores and varying cyclically the opening of the intake valve during the intake stroke.

BEST MODE FOR CARRYING OUT THE INVENTION

Figure 1:
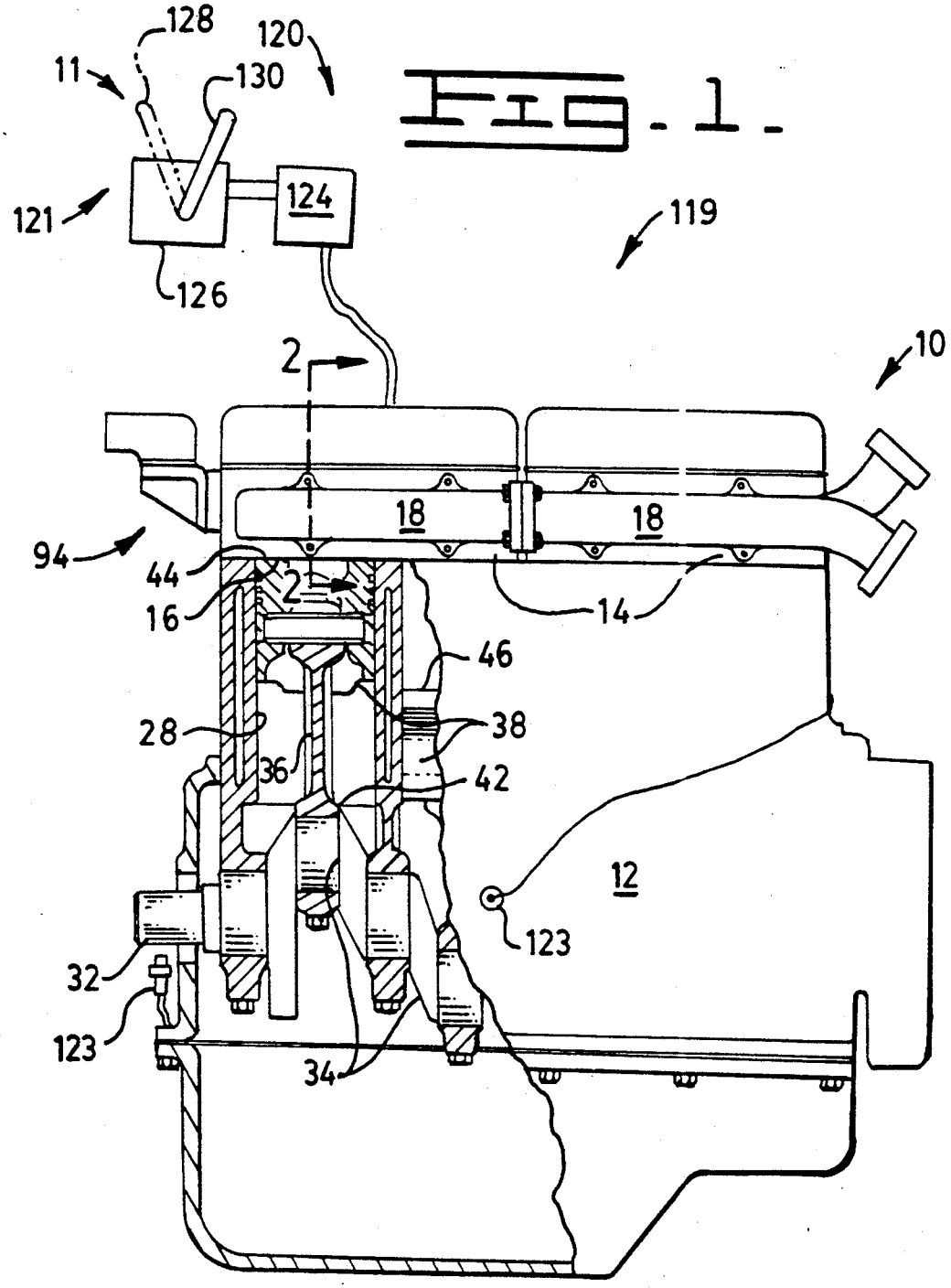
FIG. 1 is a partially sectional side view of an engine having an embodiment of the present invention.
Figure 2:
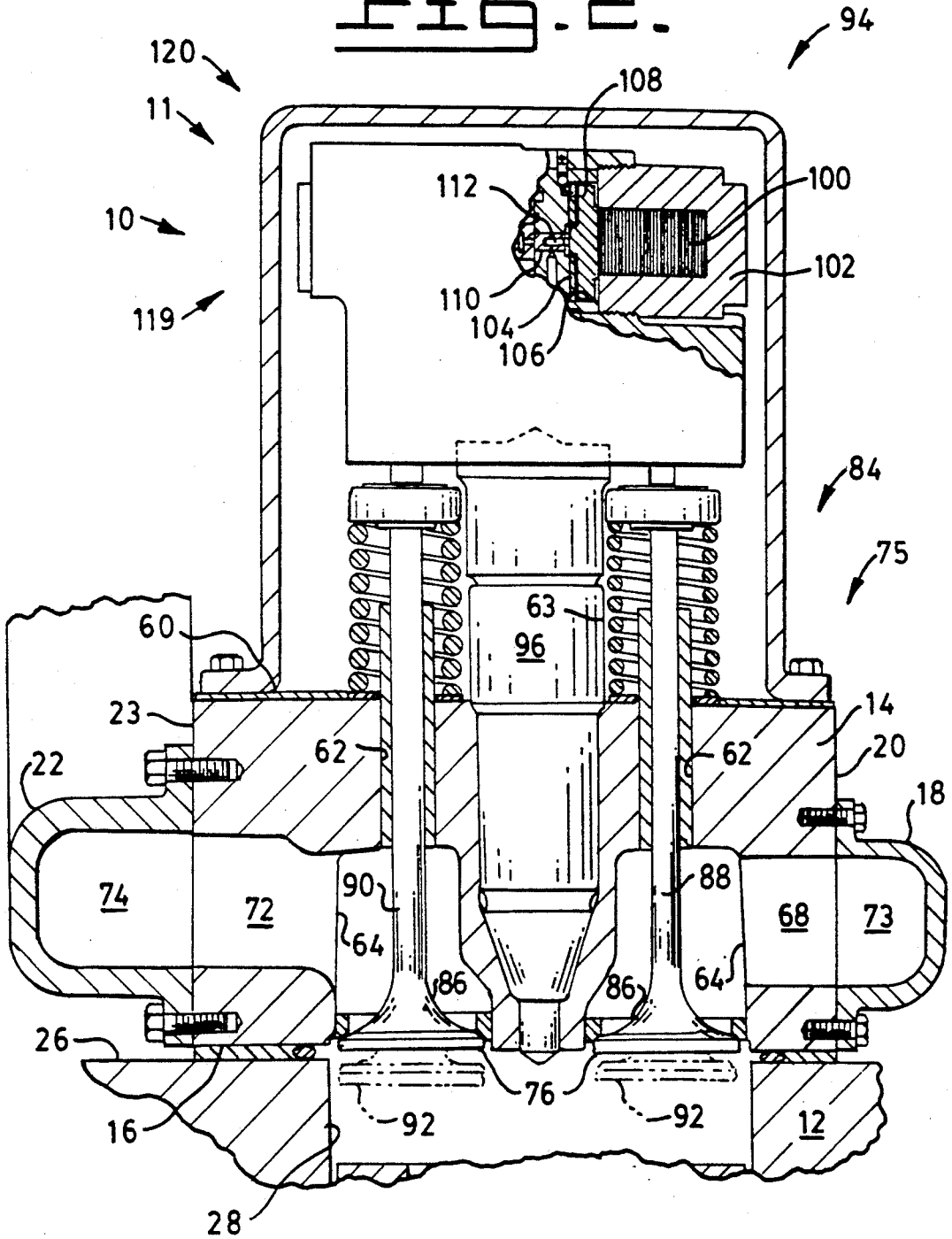
FIG. 2 is a partially sectional view taken along lines 2—2 of FIG. 1.

Referring to FIGS. 1 and 2, an internal combustion engine 10 having a conventional four cycles of compression, expansion, exhaust and intake strokes includes an engine breathing optimizing system 11 which has been adapted for use with the engine 10. The engine 10 includes a block 12 and a plurality of cylinder heads 14 rigidly attached to the block 12. A single cylinder head 14 could be used without changing the gist of the invention. Furthermore, the block 12 and the cylinder head could be of an integral design. Each of the cylinder heads include a combustion surface 16 defined thereon. An intake manifold 18 is attached to a mounting face 20 of each cylinder head 14 and an exhaust manifold 22 is attached to a mounting face 23 of each cylinder head 14.

The block 12 includes a top face 26 having a plurality of machined cylinder bores 28 therein, of which only a pair is shown. As an alternative, the block 12 could include a plurality of replaceable cylinder liners, not shown, positioned within the bores 28, without changing the gist of the invention. A crankshaft 32 having a plurality of throws 34 thereon is rotatably positioned within the block 12 in a conventional manner. A plurality of connecting rods 36 are rotatably attached to the crankshaft 32 and to a plurality of pistons 38 in a conventional manner. Each of the pistons 38, in this application, is of a single piece design. The pistons 38 could be of an articulated type design without changing the gist of the invention. Each piston 38 is positioned within a respective bore 28 in a conventional manner. Rotation of the crankshaft 32 causes individual throws 34 to move the piston 38 within the bore 28 a preestablished distance. Rotation of the crankshaft 32 causes the piston 38 to move toward the combustion surface 16 of the cylinder head 14 and further rotation of the crankshaft throw 34 causes the piston 38 to move away from the combustion surface 16. As the throw 34 reaches an apex 42 of rotation, the piston 38 is at a top dead center (TDC) position 44. Subsequently, as the throw 34 reaches a position 180 degrees from the apex 42, the piston 38 is at a bottom dead center (BDC) position 46. Each combination of the throw 34, connecting rod 32 and piston 38 follow a similar path.

As best shown in FIG. 2, the cylinder head 14 further includes a top deck 60 spaced from the combustion surface 16 a preestablished distance. A plurality of valve bores 62 axially extend between the top deck 60 and the combustion surface 16 and a plurality of injector bores 63 axially extend between the top deck and the combustion surface 16. The plurality of valve bores 62 have an enlarged portion 64 extending from the combustion surface 16 toward the top deck 60 a predetermined distance A plurality of intake passages 68 are positioned within the head 14 and each communicate between one of the enlarged portions 64 and the mounting face 20 in a conventional manner. Further positioned within the head 14 are a plurality of exhaust passages 72 each of which communicate between one of the enlarged portions 64 and the mounting face 23. The intake passages 68 are in fluid communication with an intake manifold passage 73 positioned in the intake manifold 18 and the exhaust passages 72 are in fluid communication with an exhaust manifold passage 74 positioned in the exhaust manifold 22.

A cylinder head assembly 75 includes a pair of valves 76 positioned within the plurality of bores 62 and are removably attached within the cylinder head 16 in a conventional manner. Each of the pair of valves 76, in the assembled position, is retained in sealing contact with the head 16 by a conventional spring means 84 and defines a closed position 86. At least one of the pair of valves 76 is an intake valve 88 and the other one of the pair of valves 76 is an exhaust valve 90. The pair of valves 76 could include a single intake and exhaust valve 88,90 or a combination of multi intake and exhaust valves 88,90. Each of the pair of valves 76 is moved independently into an open position 92 by a means 94 for electronically opening each of the valves 76. In the open position 92, the volume within the bore 28 is in fluid communication with at least one of the intake passages 68 and the intake manifold passage 73, or the exhaust passages 72 and the exhaust manifold passage 74. Positioned within each of the injector bores 63 is a unit fuel injector 96 of a conventional design. The unit fuel injector 96 is also opened by the means 94 for opening. As an alternative, any conventional fuel system could be used.

In the preferred embodiment, the means 94 for opening each of the valves 76 independently include a like number of piezoelectric motors 100, only one shown, although it could be one of any number of types such as solenoids or voice coils. The piezoelectric motor 100, which is well-known in the art, expands linearly after having electrical excitation by a preestablished quantity of energy and contracts when the electrical excitation is ended. Variations in the amount of electrical excitation will cause a similar variation in the linear expansion of the motor 100. For example, full electrical excitation will linearly move a greater distance than half electrical excitation. In the above example, the ratio of distance moved being approximately 2 to 1. The motor 100 is housed in a piezo-housing 102. Adjacent the piezo-housing 102 is a piston housing 104 having a stepped cavity 106 in which are positioned a driver piston 108, an amplifier piston 110, and a fluid chamber 112 therebetween.

The piezoelectric motor 100 can generate high force in the linear direction, however, its linear expansion is much less than the linear displacement required to move the pair of valves 76 from the closed position 86 to the open position 92. Therefore, the driver piston 108, amplifier piston 110 and fluid chamber 112 are provided to translate and amplify linear displacement of the motor 100 into linear displacement in the following manner. The amplifier piston 110 is sized much smaller than the driver piston 108 because the hydraulic amplification ratio of the linear displacement of the driver piston 108, as it relates to the linear displacement of the amplifier piston 110, is inversely proportional to the surface area ratio of the driver piston 108 to the amplifier piston 110. Thus, small linear displacement of the motor 100 is amplified to produce significantly greater linear displacement of the amplifier piston 110.

An electronic control system 119 is connected to the opening means 94 and has a control signal 120 directed therefrom to the opening means 94 to functionally control the engine 10 in a first predetermined logic pattern in which one of the pair of valves 76 are opened during the exhaust stroke. For example, during normal engine 10 operation the exhaust valves 90 are moved into the open position 92 during the expansion stroke when the piston 28 is approaching bottom dead center 46 and remains in the open position 92 through the exhaust stroke as the piston 28 moves from bottom dead center 46 to top dead center 44.

The engine breathing optimizing system 11 includes a breathing control means 121 for causing the control signals to be outputted to the opening means 94 in a second predetermined logic pattern different than the first predetermined logic pattern, thus forming an optimum breathing and combustion operating mode. The breathing and combustion control means 121 include the electronic control system 119, the modified control signal 120, and a plurality of engine sensors 123 which relay information concerning the operating conditions of the engine 10, for example, temperature, rpm's, load, air-fuel mixture, etc. in a conventional manner such as by wires or radio type signals, to a microprocessor 124. The microprocessor 124 uses a preprogrammed logic to process the data provided by the sensors 123 and based upon the results of the analysis outputs the control signal 120 to supply current to the various piezoelectric motors 100. The motors 100 are actuated independently of each other and thus, the intake valves 88, exhaust valves 90 and unit fuel injectors 96 are independently controlled so as to produce optimum timing events of valve opening and fuel injection for various engine 10 operating conditions.

The breathing control means 121 for causing the control signal 120 to be outputted to the opening means 94 further include a device 126 which is movable between an off position 128 and an on position 130. The device 126 is automatically actuated as the conditions monitored by the sensors 123 are fed to the microprocessor and interpreted to require the actuation of the optimum breathing operating mode. As an alternative, the device 126 could be manually actuated.

Figure 3:
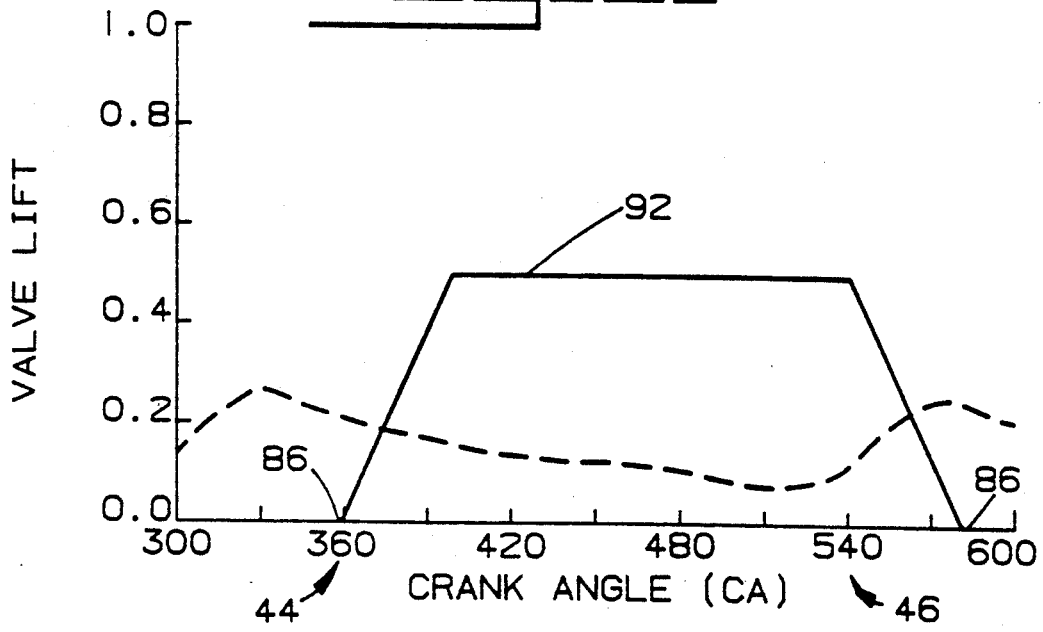
FIG. 3 is a graphic illustration of a prior art mechanism system having a tuned manifold system during which the engine speed is in phase with the dominant manifold resonance and flow to the cylinders is enhanced.

As shown in FIG. 3, the engine 10, which in this illustration is of a four stroke six cylinder configuration, has the speed thereof in phase with the resonance within the intake manifold passage 73. During the intake stroke, the piston 38 moves from top dead center 44 at about 360 degrees crankshaft 32 angle to about 540 degrees bottom dead center 46. As illustrated by the solid line, the intake valve 88 starts to open at about 360 degrees crankshaft 32 angle and is fully opened at about 400 degrees crankshaft 32 angle. The intake valve 88 remains in the fully open position until about 540 degrees crankshaft 32 angle, starts to close and is closed at about 580 degrees crankshaft 32 angle. The intake manifold passage 73 pressure resonance as shown by the dotted lines is cyclic. For example, the intake manifold passage 73 pressure reaches a maximum at about 330 degrees crankshaft 32 angle, decreases to a minimum at about 520 degrees crankshaft 32 angle and increases again to a maximum at about 580 degrees crankshaft 32 angle.

Figure 4:
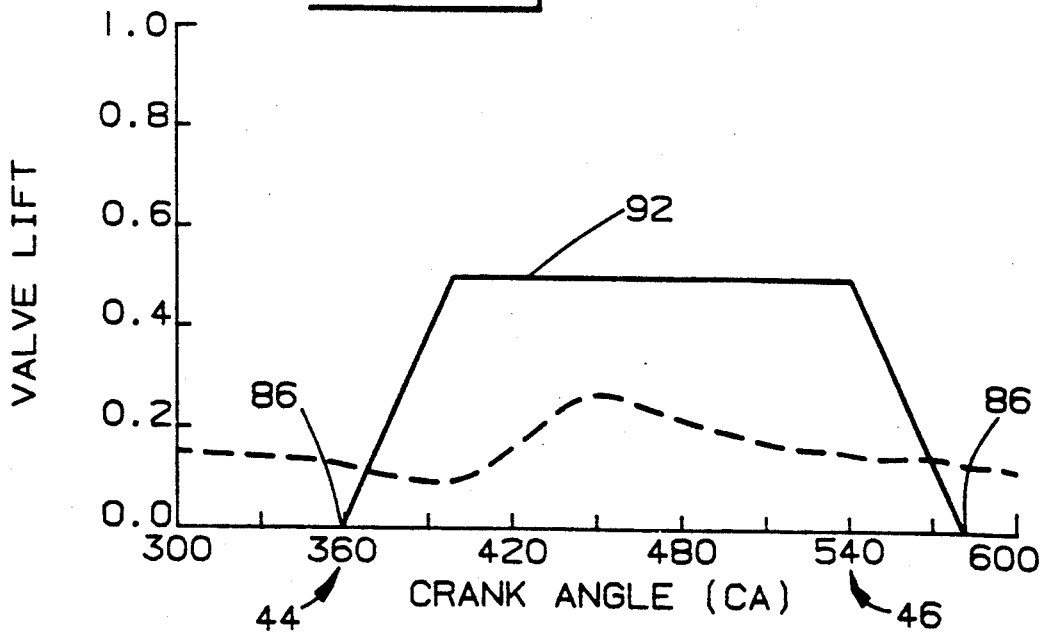
FIG. 4 is a graphic illustration of a prior art mechanical system having a tuned manifold system during which the engine speed is not in phase with the manifold resonance so that flow is not enhanced.

As shown in FIG. 4, the engine 10, which in this illustration is of a four stroke six cylinder configuration, has the speed thereof out of phase with the resonance within the intake manifold passage 73. During the intake stroke, the piston 38 moves from top dead center 44 at about 360 degrees crankshaft 32 angle to about 540 degrees bottom dead center 46. As illustrated by the solid line, the intake valve 88 starts to open at about 360 degrees crankshaft 32 angle and is fully opened at about 400 degrees crankshaft 32 angle. The intake valve 88 remains in the fully open position until about 540 degrees crankshaft 32 angle, starts to close and is closed at about 580 degrees crankshaft 32 angle. The intake manifold passage 73 pressure resonance as shown by the dotted lines is cyclic. For example, the intake manifold passage 73 pressure reaches a minimum at about 400 degrees crankshaft 32 angle and increased to a maximum at about 450 degrees crankshaft 32 angle. After reaching the maximum pressure, the cyclic resonance again decrease to a minimum.

Figure 5:
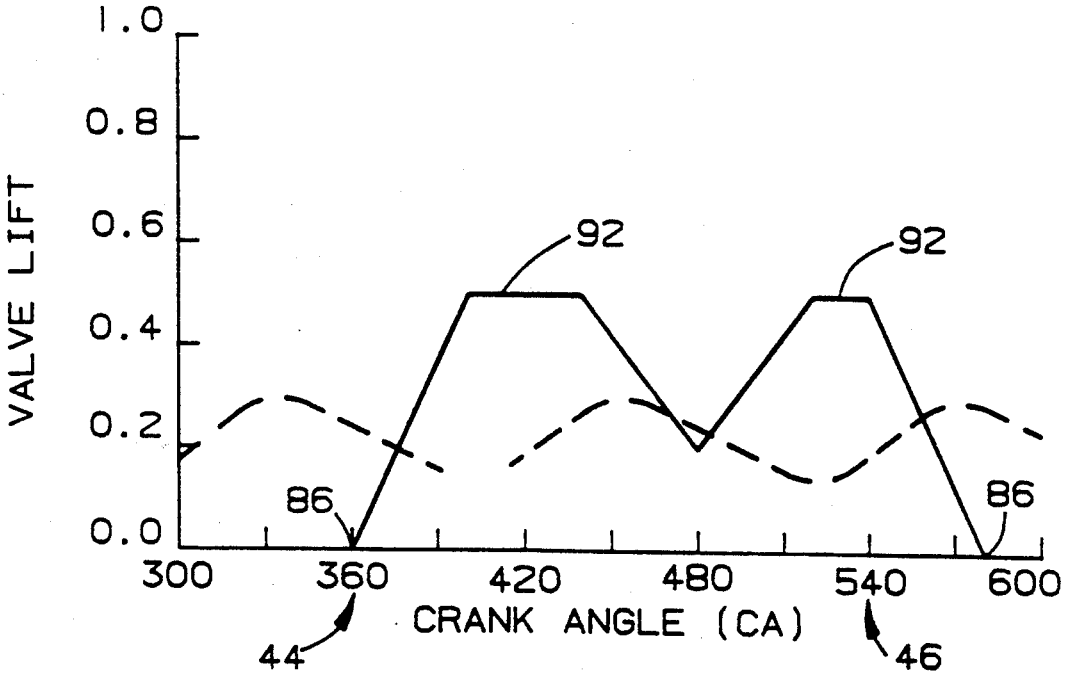
FIG. 5 is a graphic illustration of an engine having an embodiment of the present invention by which extra oscillation of the valve forces resonance.

As shown in FIG. 5, the engine 10, which in this illustration is of a four stroke six cylinder configuration, has the resonance within the intake manifold passage 73 adapted for use at various engine 10 speeds. During the intake stroke, the piston 38 moves from top dead center 44 at about 360 degrees crankshaft 32 angle to about 540 degrees bottom dead center 46. As illustrated by the solid line, the intake valve 88 starts to open at about 360 degrees crankshaft 32 angle and is fully opened at about 400 degrees crankshaft 32 angle. The intake valve 88 remains in the fully open position until about 440 degrees crankshaft 32 angle, starts to close but does not reach the closed position and at about 480 degrees crankshaft 32 angle moves back to the fully open position at about 520 degrees crankshaft 32 angle. The intake valve 88 remains in the fully open position until about 540 degrees crankshaft 32 angle at which time the intake valve 88 is moved to the closed position at about 580 degrees crankshaft 32 angle. The intake manifold passage 73 pressure resonance as shown by the dotted lines is cyclic. For example, the intake manifold passage 73 pressure reaches a maximum at about 340 degrees crankshaft 32 angle, decreases to a minimum at about 395 degrees crankshaft 32 angle and cyclic increases again to a maximum at about 460 degrees crankshaft 32 angle.

INDUSTRIAL APPLICABILITY

In use, the engine utilizes the opening means 94 to unit actuate each of the valves 76 independently. The opening means 94 allow the freedom to change timing of the pair of valve 76 events independently of crankshaft 32 rotational position. The opening means 90 having the ability to actuate each pair of valves 76 independently and the valve timing flexibility allows for better modulation of the optimized breathing system 11. For example, in operation, the breathing control means 121 is activated since the sensors 123 monitor the appropriate operating mode, such as low speed and/or low load. A combination of variables such as water temperature, exhaust temperature and/or amount of unburned fuel within the exhaust are monitored to establish the appropriate operating mode.

The object is to improve the breathing to and between the cylinder or bore 28 which, in turn improves mixing of the fuel and air, fuel economy, and reduces emissions. Functionally, in this application the intake valve 88 is intermittently moved between the closed position 86 and the open position 92 in the second predetermined logic pattern. Each opening of the valve 88 during the intake stroke of the piston 28 allows the piston 28 to take a gulp of air from the intake passage 73. The intermittent opening 92 and closing 86 of the valve 88 allows the piston 28 to take gulps at preestablished intervals. The preestablished gulps causes the air within the passage 73 to pulsate in a predetermined mode. The controlled opening 92 and closing 86 of the valve 88 is used to set up controlled harmonics, sympathetic vibrations or pressure waves which is used to increase the amount of air inducted into the respective bore 28. For example, the valve 88 is opened at the appropriate interval when the pressure wave is moving toward the valve 88. The results of the opening increases the quantity of air taken by the gulp of the piston 28 due to the increase in velocity and volume of the air being drawn from the passage 73.

Referring to FIGS. 3 and 4, the prior art mechanical mechanism use to optimize engine breathing will be compare with the engine breathing optimizing system 11 as graphically shown in FIG. 5. The assembly of mechanical components shown in FIGS. 3 and 4 have a generally fixed relationship. The camshaft opens the intake valve relative to the crankshaft angle at about the same relationship during the intake stroke. Thus, the piston takes a gulp of air from the intake manifold and a preestablished resonance is set-up within the manifold system. The design of the manifold system as shown in FIG. 3 is such that at a given speed, about 750 RPM, the resonance produces a high surge or pressure in the manifold system corresponding to the interval at which the intake valve during the intake stroke is closing. For example, the graphic representation of the intake valve is shown by the solid line and the graphic representation of the intake manifold pressure is shown by the dotted line. As illustrated by the crossing of the dotted and the solid line during the peak pressure within the intake manifold and the closing of the intake valve better charging of intake air will occur in the bore 28. The design of the intake system to produce the precise resonance is dependent on time relationship between the valve opening and closing, piston relationship, vibrations within the intake system and the precise configuration of the mechanical system. As shown in FIG. 4, as the speed of the engine increased the resonance within the precise configuration of the mechanical system does not provide the proper relationship to increase the charging of intake air into the bore 28. For example as graphically shown in FIG. 4, the crossing of the solid line, intake valve 88, during the closing of the intake valve 88 and pressure dotted line within the intake manifold passage 73 occurs at an interval wherein the intake manifold passage 73 pressure is at other than maximum. Thus, the mechanical structure as shown in FIGS. 3 and 4 fails to provide an intake manifold passage 73 resonance which is usable throughout the entire speed range of the engine 10. As graphically shown in FIG. 5, the opening means 94 which allows the freedom to change timing of the valve 76 events independently of crankshaft 32 rotational position, has been adapted to efficiently increase engine breathing system 11 functions. For example, the resonance within the intake manifold passage 73 has been altered to correspond to the engine 10 speed. This phenomena is accomplished by varying the lift of the intake valve 88 during the intake stroke. As the the intake valve 88 lift is reduce and the piston continues to intake air the velocity of the air is increased. As the intake valve 88 lift is increased and the piston continues to intake air the velocity of the air is decreased. Thus, the continuing variation of the valve 88 lift changes the resonance in the intake manifold. As a result of the varying of the valve 88 lift the resonance within the intake manifold passage 73 is altered to effectively provide a resonance at which the intake valve 88 is closing simultaneously with the maximum pressure pulse within the intake manifold passage 73. The engine 10 breathing and combustion system 11 which utilizes the opening means 94 makes this adaptation possible. For example, as shown in FIG. 5, even though the engine 10 speed is out of phase with the mechanical manifold geometry the induced resonance caused by varying the opening and partial closing of the intake valve 88 induces higher frequency within the intake passage 73. The opening and partial closing of the valve 88 enhances the resonance so that when the intake valve 88 is closing the pressure within the manifold passage 73 is at or near its peak resulting in better charging of the bore 28 with intake air. The opening means 94 can be programmed to simulate this phenomena at all engine 10 speeds thus, enhancing engine 10 breathing and combustion.

The present invention provides an efficient and cost effective engine breathing and combustion optimizing system 11 without the addition of expensive mechanical mechanisms. The electronic control system 119 can be utilized to activate the opening means 94 to vary the conventional first predetermined logic pattern and provide a second predetermined logic pattern or varied operating mode depending on the work environment. The individual actuation of the pair of valves 76 makes it possible to control the opening position 92 and closing position 86 of the valves 76 independently of the crankshaft 32 angle. Thus, a more efficient cost effective engine breathing optimizing system 11 can be utilized.

Other aspects, objects and advantages of this invention can be obtained from a study of the drawings, the disclosure and the appended claims.

I claim:

1. A breathing optimizing system adapted for use with an engine including a passage communicating with a pair of bores, a piston during operation of the engine being movably positioned within respective bores between a top dead center position and a bottom dead center position forming an intake stroke, a pair of intake valves being operatively associated between the passage and the respective bore and controlling communications between the passage and the respective bore having a closed position and an open position, said breathing optimizing system comprising:

means for opening each of the valves independently in response to receiving a control signal;

an electronic control system connected to the opening means and outputting the control signals to the opening means in a first predetermined logic pattern during normal engine operation wherein one of said pair of valves is in the generally open position during the intake stroke;

breathing control means connected to the electronic control system for causing discrete control signals to be outputted to the opening means in a second predetermined logic pattern to vary the operation of the valves so that the opening of one of the intake valves associated with the respective bores is cyclically varied during the intake stroke to effectively cause a preestablished resonance within the passage to effect an increase in the flow into the respective bore during the movement of the piston within the respective bore between the top dead center position and the bottom dead center position.

2. The breathing system of claim 1 wherein said second predetermined logic pattern varies the operation of the valves depending on the operating mode of the engine.

3. The breathing system of claim 2 wherein said first predetermined logic pattern and said open position of the valves have a preestablished lift.

4. The breathing system of claim 3 wherein said second preestablished logic pattern and said open position of the valve has a preestablished lift being less than the lift of the first predetermined logic pattern.

5. The breathing system of claim 1 wherein said opening means includes a piezoelectric motor.

6. An engine having a passage being in communication with a pair of bores, a piston during operation of the engine being movably positioned within respective bores between a top dead center position and a bottom dead center position forming an intake stroke, a pair of intake valves operatively associated between the passage and the respective bore and having a closed position and an open position, the improvement comprising; means for opening each of the valves independently in response to receiving a control signal, an electronic control system connected to the opening means and outputting the control signals to the opening means in a first predetermined logic pattern during normal engine operation wherein one of said pair of valves is in the open position during the intake stroke, breathing control means being connected to the electronic control system for causing discrete control signals to be outputted to the opening means in a second predetermined logic pattern varying the operation of the valves so that the opening of one of the intake valves associated with the respective bore is cyclicablly varied during the intake stroke to cause a preestablished resonance within the passage to effect an increase in the flow into the respective bore during the movement of the piston within the respective bore between the top dead center position and the bottom dead center position.

7. The engine of claim 6 wherein said second predetermined logic pattern varies the operation of the valve depending on the operating mode of the engine.

8. The engine of claim 7 wherein said first predetermined logic pattern and said open position has a preestablished lift.

9. The engine of claim 8 wherein said second predetermined logic pattern and said open position of the valve has a preestablished lift being less than the lift of the first predetermined logic pattern.

10. The engine of claim 7 wherein said opening means includes a piezoelectric motor.

11. A method for optimizing the breathing of an engine having a passage communicating with a pair of bores, a piston during operation of the engine being movably positioned within respective bores between a top dead center position and a bottom dead center position forming an intake stroke, a pair of intake valves operatively associated between the passage and the respective bore and having a closed position and an open position comprising the steps of:

(a) monitoring the operating condition of the engine;

(b) outputting a control signal to an opening means during a first predetermined logic pattern in which the engine is in a generally normal operating mode;

(c) outputting a discrete control signal to the opening means during a second predetermined logic pattern;

(d) varying the operation of the valves associated with the respective bores; and (e) varying cyclically the opening of one of the valves during the intake stroke.

12. The method of optimizing the breathing of an engine of claim 11 wherein the step of varying the operation of the valves associated with the respective bores includes operating one of said intake valves.

13. The method of optimizing the breathing of an engine of claim 12 wherein the step of varying the operation of the valves associated with the respective bores includes varying a lift of said one of the intake valves.

* * * * *